US006581554B2

(12) United States Patent
Hettmann

(10) Patent No.: US 6,581,554 B2
(45) Date of Patent: Jun. 24, 2003

(54) INTERNAL COMBUSTION ENGINE HAVING A DIAPHRAGM CARBURETOR AND ADJUSTABLE CO LEVEL

(75) Inventor: Heinz Hettmann, Schorndorf (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 10/059,785

(22) Filed: Jan. 29, 2002

(65) Prior Publication Data

US 2002/0100437 A1 Aug. 1, 2002

(30) Foreign Application Priority Data

Feb. 1, 2001 (DE) ..... 101 04 445

(51) Int. Cl.[7] ..... F02B 33/04
(52) U.S. Cl. ..... 123/73 A; 123/73 R
(58) Field of Search ..... 123/73 R, 73 A, 123/73 PP

(56) References Cited

U.S. PATENT DOCUMENTS 4,814,114 A * 3/1989 Charmley ..... 261/35

FOREIGN PATENT DOCUMENTS

DE 19900445 A1 7/2000

* cited by examiner

*Primary Examiner*—Noah P. Kamen
(74) *Attorney, Agent, or Firm*—R W Becker & Associates; R W Becker

(57) ABSTRACT

An internal combustion engine, especially a two-stroke engine in manually-guided implement, is provided. A piston that is disposed in a cylinder delimits a combustion chamber and by means of a connecting rod drives a crankshaft disposed in a crankcase. A fuel/air mixture is supplied to the engine via a diaphragm carburetor, the control chamber of which is delimited by a control diaphragm that controls a feed valve. Formed on the dry side of the diaphragm is a compensation chamber that communicates via a flow path with a source of pressure that pulsates as a function of engine speed. Disposed in the flow path is a check valve. The compensation chamber is to be relieved by a pressure-regulating valve disposed in a further flow path.

9 Claims, 3 Drawing Sheets

INTERNAL COMBUSTION ENGINE HAVING A DIAPHRAGM CARBURETOR AND ADJUSTABLE CO LEVEL

BACKGROUND OF THE INVENTION

The present invention relates to an internal combustion engine, especially for a portable, manually-guided implement such as a power chain saw, a cut-off machine, a brush cutter or the like. The engine has a cylinder and a crankcase, with a reciprocating piston in the cylinder that together with the cylinder delimits a combustion chamber. The piston drives a crankshaft that is rotatably mounted in the crankcase. A diaphragm carburetor is provided for supplying a fuel/air mixture for operation of the engine, whereby the carburetor has a control chamber that is delimited by a control diaphragm and to which fuel flows via a feed valve that is controlled by the control diaphragm. A compensation chamber is formed on the dry side of the control diaphragm.

An internal combustion engine of this type is known from DE 199 00 445 A1. The fuel/air mixture is drawn into the crankcase and, as the piston moves downwardly, is conveyed into the combustion chamber via transfer channels. To reduce the scavenging losses, in particular the transfer channels that are disposed close to the exhaust communicate via diaphragm valves with air channels that supply clean air, so that the rich mixture is shielded from the exhaust or outlet means by the in-flowing air. This known engine has a good exhaust gas characteristic at low fuel consumption.

The drawback is that such an engine operates leaner under full load and reduced speed, since in such an operating state an over proportional amount of air that is free of fuel is supplied via the air channels. The power of the engine drops, which can lead to a further reduction in speed.

It is therefore an object of the present invention to improve an internal combustion engine of the aforementioned general type in such a way that a powerful output is ensured even at a speed that drops under full load.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The internal combustion engine of the present invention is characterized primarily in that the compensation chamber communicates via a flow path with a source of pressure that pulsates as a function of engine speed, wherein a check valve is disposed in the flow path from the source of pressure to the compensation chamber, and in that the compensation chamber is to be relieved via a pressure-regulating valve that is disposed in a further flow path.

The check valve, which is disposed in the flow path from the source of pressure to the compensation chamber, effects a raising of the average value of the pulsating pressure of the pressure source. If as the source of pressure the intake channel or the clean air chamber of an air filter is utilized, an average pressure value can be read in the stationary operating state. Depending upon how it is switched, the check valve allows upper or lower pressure peaks to occur, so that on that side of the check valve that faces away from the source of pressure merely those pressure peaks occur that lead to a greater average pressure value. Thus, depending upon the desired influence of the control diaphragm, the positive or negative pressure peaks of the pulsating pressure of the pressure source can be stored in the compensation chamber. Depending upon the condition of the internal combustion engine that is to be operated, this can be utilized such that at a speed that drops at full load, the fuel flow is influenced and set in such a way that a powerful output is ensured. So that the average pressure value in the compensation chamber is adapted in a time-delayed manner to the respective stationary operating state of the internal combustion engine, it is provided to permanently relieve the compensation chamber via a pressure-regulating valve that is disposed in a further flow path.

A reliable effect can be achieved if the cross-sectional area of the pressure-regulating valve is less than, and preferably several times less than, the cross-section area of flow of the check valve.

The pressure-regulating valve for the respective internal combustion engine is expediently structurally fixed in position and is embodied as a fixed throttle, so that it is possible in a straightforward manner to have a mass production of the diaphragm carburetor that is provided for the internal combustion engine.

Further specific features of the present invention will be described in detail subsequently.

DESCRIPTION OF PREFERRED EMBODIMENTS

Figure 1:
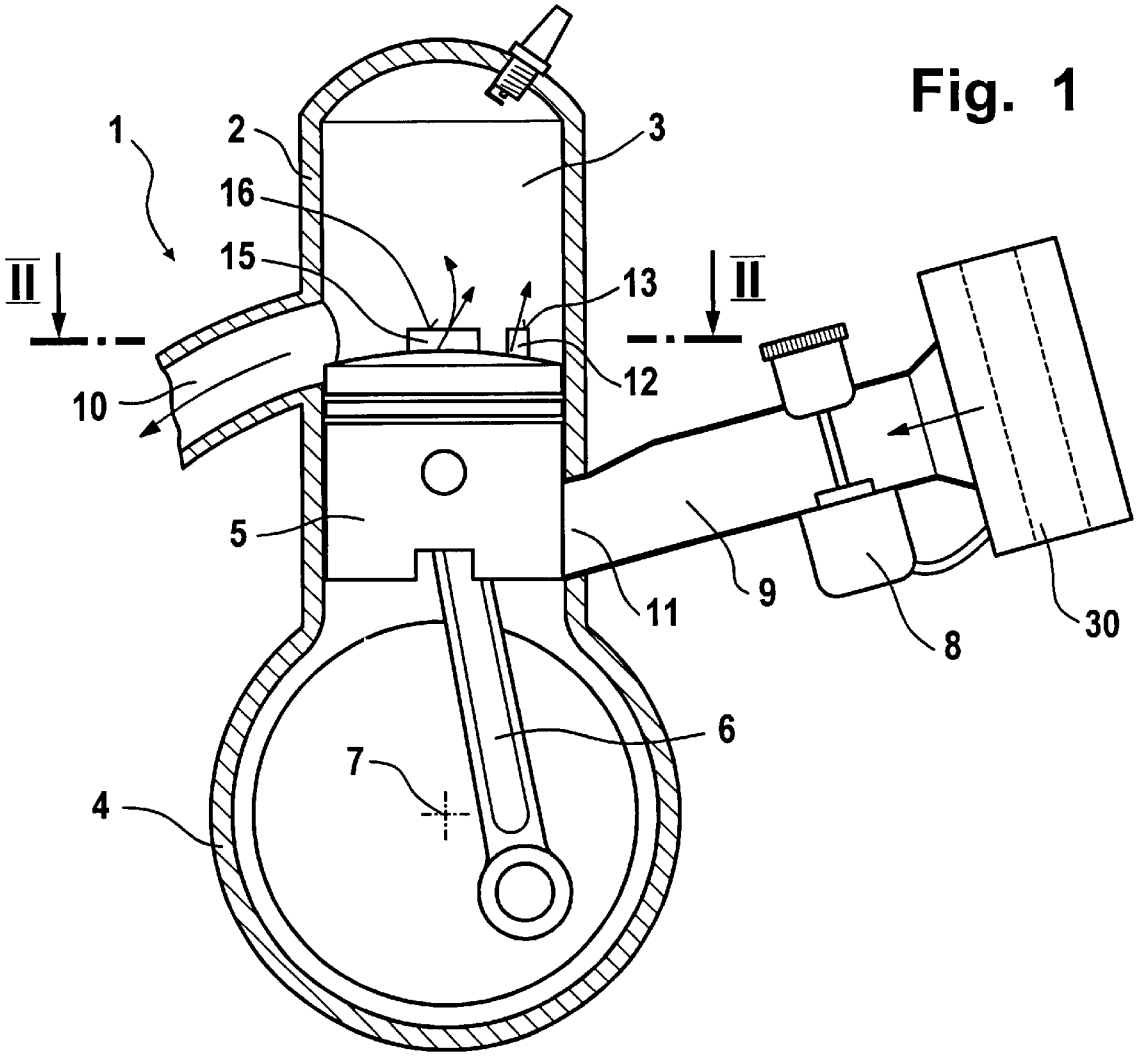
FIG. 1 is a cross-sectional view through a two-stroke engine having four gas-conveying channels.
Figure 2:
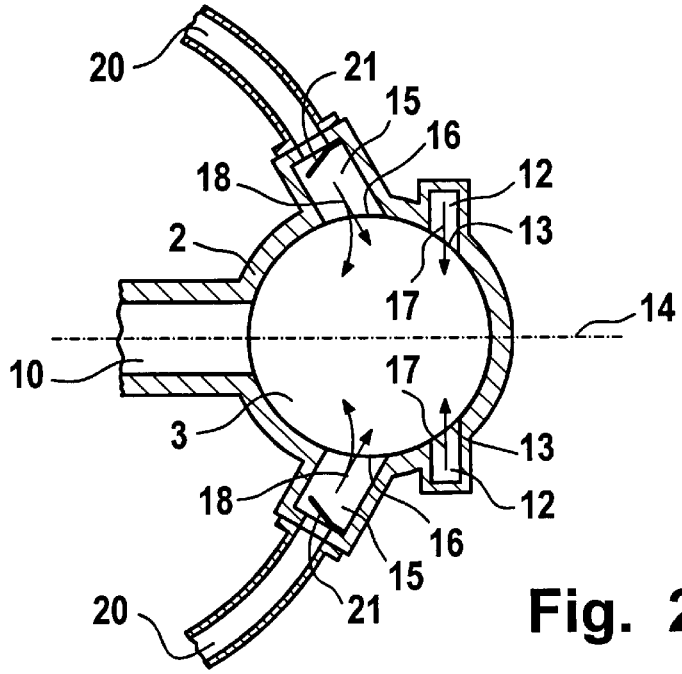
FIG. 2 is a cross-sectional view taken along the line II—II in FIG. 1.

Referring now to the drawings in detail, the internal combustion engine 1 that is schematically illustrated in FIGS. 1 and 2 is preferably a single cylinder engine, and is particularly embodied as a two-stroke engine with or without scavenging collection. Such a two-stroke engine is advantageously used, in particular, as a drive engine in a portable, manually-guided implement such as a power chain saw, a cut-off machine, a brush cutter, a hedge trimmer, or the like.

The internal combustion engine 1 comprises a cylinder 2 and a crankcase 4, as well as a piston 5 that reciprocates in the cylinder 2. The piston 5, along with the cylinder 2, delimits a combustion chamber 3, and by means of a connecting rod 6 drives a crankshaft 7 that is rotatably mounted in the crankcase 4.

Associated with the combustion chamber 3 is an exhaust means 10 by means of which the exhaust gases exit. The fuel/air mixture that is necessary for operation of the internal combustion engine is prepared in a Venturi of a diaphragm carburetor 8, and is supplied to the crankcase 4 via an intake channel 9 and an inlet 11. The crankcase 4 is connected with the combustion chamber 3 by means of at least two transfer channels 12. The inlet windows 13 of the transfer channels 12, which inlet windows open out into the combustion chamber 3, are disposed approximately diametrically opposite one another relative to an axis of symmetry 14.

As viewed in the circumferential direction of the cylinder 2, a respective further channel 15, which is closer to the exhaust means 10, is disposed between such exhaust means and the transfer channels 12, which are disposed further from the exhaust means 10; the inlet windows 16 of the channels 15 are disposed across from one another. The channels 15 are advantageously also open to the crankcase 4, although in the region of the inlet window 16 the channels 15 are in communication with an external air channel 20 via a diaphragm valve 21; exclusively fuel-free air is supplied to the internal combustion engine via the air channels 20. The rich fuel/air mixture flows in the direction of the arrows 17 into the combustion chamber 3 remote from the exhaust means, while the air previously collected in the transfer channels 15 enters the combustion chamber in the direction of the arrows 18 as a protective curtain.

The piston 5, in a manner known per se, controls the exhaust means 10, the inlet 11, as well as the inlet windows 13 and 16 of the transfer channels 12 and 15. During an upward movement of the piston 5, all of the channels 12 and 15 that open out in the combustion chamber 3 are closed, whereas the inlet 11 of the diaphragm carburetor 8 is open to the crankcase 4. As a consequence of the upwardly moving piston 5, there results in the crankcase 4 an underpressure or partial vacuum, which is compensated for by an intake of a fuel/air mixture via the inlet 11. Since the transfer channels 12 and 15 are open to the crankcase 4, the overpressure that results in the crankcase 4 at the same time effects an intake of air via the air channels 20 and the diaphragm valves 21, which are open due to the pressure conditions. The large-volume transfer channels 15 which are close to the exhaust means fill with air, whereby as the pressure compensation in the crankcase increases, the diaphragm valves 21 close and prevent further air from flowing in. Thus, essentially pure air is present in the transfer channels 15 that are close to the exhaust means.

After the ignition of the compressed mixture in the combustion engine 3, which ignition is effected in the vicinity of the upper dead center position, the piston 5 is moved downwardly by the pressure of the explosion in the direction toward the crankcase 4, whereby due to the position of the inlet windows 13 and 16, the exhaust means 10 is initially opened and a portion of the pressurized exhaust gases escapes. During the further downward movement of the piston 5, the inlet windows 13 and 16 of the transfer channels 12 and 15 open, simultaneously in the illustrated embodiment, whereby exclusively rich fuel/air mixture flows in via the channels 12, whereby due to the overpressure that builds up in the crankcase 4, the volume of air previously collected in the channels 15 that are close to the exhaust means is pushed into the combustion chamber 3 via the inlet windows 16. The air, which enters in the direction of the arrows 18, is disposed in front of the exhaust means 10 in the manner of a protective curtain, so that the rich mixture is prevented from escaping.

Figure 3:
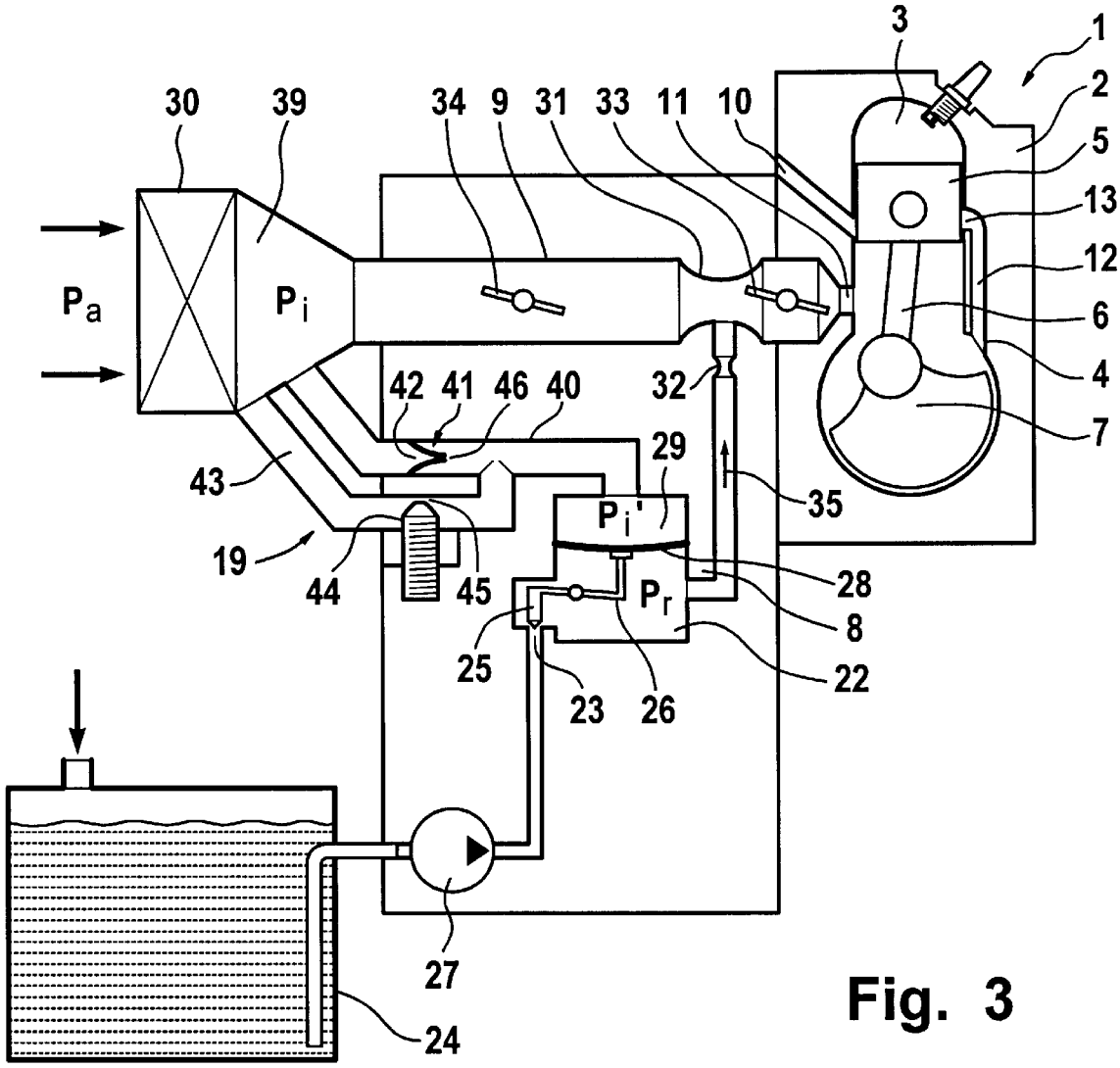
FIG. 3 is a schematic operational diagram of the two-stroke engine of FIG. 1 with a diaphragm carburetor.
Figure 5:
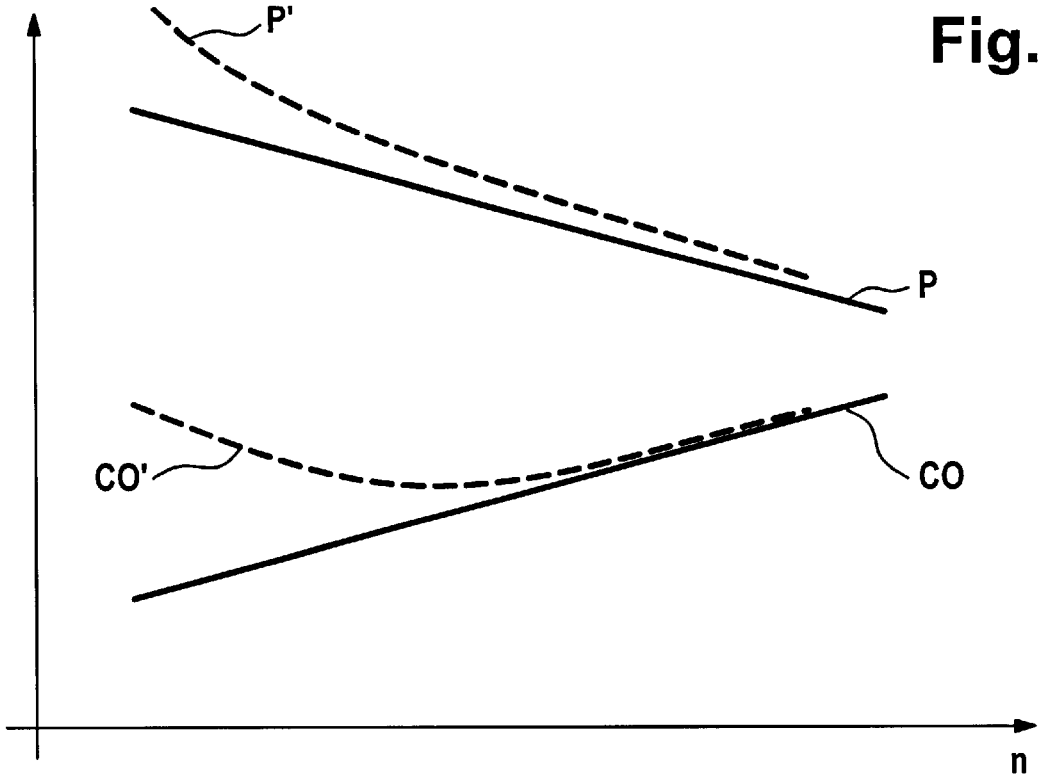
FIG. 5 is a graph with comparable curves of the pressure P and of the carbon monoxide portion CO with and without a mean pressure regulator.
Figure 6:
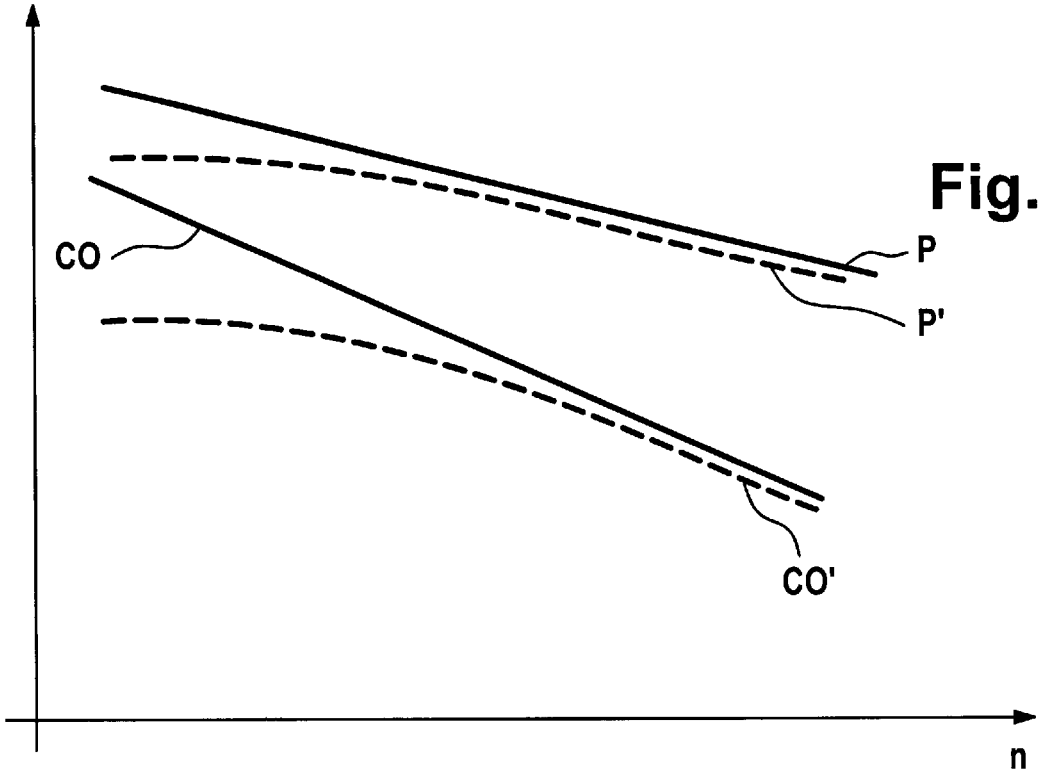
FIG. 6 shows a different distribution of the pressure P and of the carbon monoxide portion CO in a corrected and non-corrected state.

As shown in FIGS. 5 and 6, the carbon monoxide portion CO in the exhaust gas varies considerably with respect to the speed "n" of the internal combustion engine 1. Thus, for example with an internal combustion engine as in FIG. 1, the CO curve (FIG. 5) that drops at low speeds can be easily recognized; at full load and dropping speed this leads to a leaner mixture. As the speed drops under load, an over proportional amount of air is supplied via the air channels 20 to the internal combustion engine 1; this results in a loss of power, and can lead to having the engine die. In order to ensure a largely constant lambda in the combustion chamber 3 over the entire speed range of the internal combustion engine, in other words, to achieve a flat CO curve, the diaphragm carburetor 8 is provided with a mean pressure regulator 19 (FIG. 3). The construction and manner of operation is described subsequently with the aid of the schematic operational diagram of FIG. 3.

The diaphragm carburetor 8 essentially comprises a control chamber 22 to which fuel is supplied from a fuel tank 24 via a feed valve 23 using a fuel pump 27. In this connection, the valve member 25 is controlled by a control diaphragm 28 via a lever mechanism 26. The control diaphragm 28 delimits the control chamber 22; a compensation chamber 29 is formed on the dry side of the control diaphragm 28.

The air for combustion that flows in the direction of the arrows through the air filter 30 during operation of the internal combustion engine 1 flows through the Venturi section 31 of the diaphragm carburetor 8 and thereby, due to the pressure conditions, feeds fuel into the intake channel 9 via a main nozzle 32. The mixture formed thereby enters the crankcase 4 via the inlet 11. For control purposes, a butterfly valve 33 is disposed in the region of the Venturi section 31, and upstream of the butterfly valve 33 a choke valve 34 is provided.

The fuel that is flowing in the direction of the arrow 35 leads to a pressure $P_r$ in the control chamber 22, with this pressure effecting a deflection of the control diaphragm 28 and hence an opening of the feed valve 23. Fuel can continue to flow from the fuel tank 24 for pressure equalization.

The pressure that is present in the compensation chamber 29 is utilized for the control of the control diaphragm 28 and hence for influencing the feed valve 23 and the pressure conditions $P_r$ in the control chamber 22. By means of a flow path 40, the compensation chamber 29 is in communication with a pressure source that pulsates as a function of the engine speed; this pressure source can be formed, for example, by the intake channel 9 or the clean air chamber 39 of the air filter 30. Disposed in the flow path 40 from the compensation chamber 29 to the clean air chamber 39 of the air filter 30 is a one-way valve, in other words, a check valve 41. In the illustrated embodiment, the check valve 41 is embodied as a duck-bill valve 42 that is disposed so that it opens in the direction of flow to the compensation chamber 29.

The check valve 41 effects a raising of the average pressure value $P_M$ to $P_M$. Pulsating pressure fluctuations occur in the clean air chamber 39 and are illustrated at the left in FIG. 4. With the butterfly 33 opened and at a lower speed, there results a pulsation curve 36 having pronounced amplitudes. This leads to an average pressure value $P_M$ in the clean air chamber 39.

Downstream of the check valve 41 there occur merely the pressure peaks 36', which lead to an average pressure value $P'_M$ that is greater than the average pressure value PM in the clean air chamber 39 by the value ΔP. The higher average pressure value $P_M$ in the compensation chamber 29 leads already at low partial vacuums $P_r$ to a deflection of the control diaphragm 28 in a sense of an opening of the feed valve 23. An increased amount of fuel exits at the main nozzle 32, so that at a reduced speed under full load, the increasing average pressure value $P'_M$ effects an increased fuel supply, which leads to a raising of the carbon monoxide curve in the lower speed range. This is illustrated by the dashed line curve CO' in FIG. 5.

Figure 4:
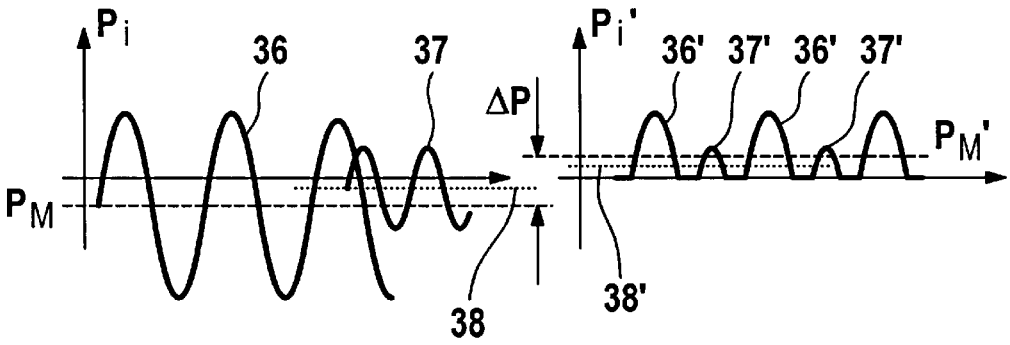
FIG. 4 schematically illustrates the pressure distribution prior to and after the mean pressure regulator.

Since at high speeds the pressure fluctuations in the clean air chamber 39 have a smaller amplitude in conformity with the pulsation curve 37 in FIG. 4, an average pressure value 38, which in indicated by a dotted line, is established in the clean air chamber 39. As a consequence of the check valve 41, downstream of the duck-bill valve 42 merely a small pressure peak 37' is effected; the pressure peaks 37' lead to an average pressure value 38' that is only slightly greater than the average pressure value 38 of the pulsation curve 37. At higher speeds, the mean pressure regulator 19 thus has hardly any effect upon the carbon monoxide, i.e. the pressure curve, so that at high speed the curves remain essentially unchanged. To ensure a conformation of the average pressure value $P'_M$ present in the compensation chamber 29 to the respective operating condition, the compensation chamber 29 communicates with the pressure source, i.e. the clean air chamber 39, via a further flow path 43, in which is disposed a throttle or pressure-regulating valve 44. The compensation chamber 29 is relieved by means of the pressure-regulating valve 44, so that there results a time-delayed adaptation of the average pressure value $P'_M$ to the respective stationary state of operation of the internal combustion engine. The cross-sectional area 45 of the pressure-regulating valve 44 is less than the cross-sectional area 46 of the flow of the check valve 41. The cross-sectional area 45 of the pressure-regulating valve 44 is preferably several times less than the cross-sectional area 46 of the flow. In this connection, the pressure-regulating valve 44 is expediently provided as a fixed throttle that in particular can be provided as a bypass to the check valve 41.

In the embodiment illustrated in FIG. 3, the check valve 41 is switched open in the direction of flow toward the compensation chamber 29; in this way, pursuant to FIG. 5, a raising of the pressure curve and of the carbon monoxide curve can be achieved at low speeds. If the check valve 41 is arranged in a direction toward the clean air chamber 39 of the air filter 30, there then results the opposite effect. The average pressure value in the compensation chamber 29 is lowered; an actuation of the control diaphragm 28 therefore requires greater forces. At full load, there consequently results, in a direction toward the lower speed ranges, a lowering of the pressure curve P' and of the carbon monoxide curve CO' as illustrated in FIG. 6. The operative position of the one-way valve, i.e. the check valve 41, is thus determined by the established path of the carbon monoxide curve CO of the internal combustion engine 1.

The specification incorporates by reference the disclosure of German priority document DE 101 445.3 of Feb. 1, 2001.

The present invention is, of course, in no way restricted to the specific disclosure of the specification and drawings, but also encompasses any modifications within the scope of the appended claims.

I claim:

1. An internal combustion engine, which has a cylinder and a crankcase, wherein a piston, which reciprocates in the cylinder, together with the cylinder delimits a combustion chamber, and wherein said piston drives a crankshaft that is rotatably mounted in the crankcase, said internal combustion engine further comprising:

a diaphragm carburetor for supplying a fuel/air mixture for operation of said internal combustion engine, wherein said diaphragm carburetor is provided with a control diaphragm that delimits a control chamber to which fuel flows via a feed valve that is controlled by said control diaphragm, wherein said control diaphragm, on a dry side thereof remote from said control chamber, also delimits a compensation chamber, wherein said compensation chamber communicates via a flow path with a source of pressure that pulsates as a function of a speed of said internal combustion engine;

a check valve disposed in said flow path between said source of pressure and said compensation chamber; and a pressure-regulating valve that is provided in a further flow path for relieving said compensation chamber.

2. An internal combustion engine according to claim 1, wherein said pressure-regulating valve has a cross-sectional area that is less than, preferably several times less than, a cross-sectional area of flow of said check valve.

3. An internal combustion engine according to claim 1, wherein said check valve and said pressure-regulating valve form a mean pressure regulator.

4. An internal combustion engine according to claim 1, wherein an air filter having a clean air chamber is disposed upstream of said diaphragm carburetor, and wherein said flow paths communicate with said clean air chamber of said air filter.

5. An internal combustion engine according to claim 1, wherein said pressure-regulating valve is a fixed throttle.

6. An internal combustion engine according to claim 1, wherein said check valve is a duck-bill valve.

7. An internal combustion engine according to claim 1, wherein said check valve opens in a direction of flow toward said compensation chamber.

8. An internal combustion engine according to claim 1, wherein said further flow path, with said pressure-regulating valve, is provided as a bypass to said check valve.

9. An internal combustion engine according to claim 1, wherein at least one air channel is provided, wherein a fuel-containing mixture is supplied to said internal combustion engine via said diaphragm carburetor, and wherein essentially clean air for combustion is supplied to said internal combustion engine via said at least one air channel.

* * * * *